US006050307A

United States Patent [19]

Conti

[11] Patent Number: 6,050,307

[45] Date of Patent: Apr. 18, 2000

[54] METHOD AND APPARATUS FOR REMOVING A HEAVIER LIQUID FROM A CONTAINER HAVING MULTIPLE LIQUIDS

[76] Inventor: Armand R. Conti, 16641 Heiser Rd., Berlin Center, Ohio 44401

[21] Appl. No.: 09/140,245

[22] Filed: Aug. 26, 1998

[51] Int. Cl.[7] ..... B65B 1/08

[52] U.S. Cl. ..... 141/4; 141/53; 141/64; 141/94; 141/95

[58] Field of Search ..... 141/4, 54, 63, 141/64, 67, 94, 95, 285, 309, 311 R, 323, 325, 368; 222/204, 394, 399, 400.7; 239/337; 169/9, 13, 15, 71

[56] References Cited

U.S. PATENT DOCUMENTS 3,527,391 9/1970 Di Muria ..... 222/400.7
5,244,021 9/1993 Hau ..... 141/285
5,586,588 12/1996 Knox ..... 141/285
5,699,940 12/1997 Clark, II ..... 222/394

*Primary Examiner*—Henry J. Recla
*Assistant Examiner*—Timothy L. Maust
*Attorney, Agent, or Firm*—Clifford A. Poff

[57] ABSTRACT

A method and apparatus for removing a heavier liquid from a container having a cover and containing a plurality of liquids of differing specific gravities. A sealable access is provided in the cover and a conduit having an end positioned within the liquid to be removed is connected at an opposite end to the sealable access. A superatmospheric medium is introduced into the container through the sealable access to create a pressure on a lighter liquid which acts as a plunger to pressurize the heavier liquid and force it through the conduit to be ejected to an exterior location via the sealable access.

15 Claims, 3 Drawing Sheets

METHOD AND APPARATUS FOR REMOVING A HEAVIER LIQUID FROM A CONTAINER HAVING MULTIPLE LIQUIDS

BACKGROUND OF THE INVENTION

1. Field of the Invention

The present invention relates to a method and apparatus for removing a heavier liquid from among a plurality of liquids having varying specific gravities, and more particularly to placing pressure on a lighter liquid to force the heavier liquid from the container through a conduit.

2. Description of the Prior Art

A commonly known method of removing a liquid from a container is through a syphoning process in which the liquid is drawn from a first level, through a tube which has been inserted into the container, to a second lower level. Such a method, however, requires an initial priming step in order to establish a flow of liquid in the tube. Furthermore, because syphoning requires that the exit end of the tube be located at a level which is below the level of the liquid being removed, the process is not applicable to an application such as underground liquid storage containers for which there is no access to place the exit end of a syphon tube at a level which is below the level of the liquid being removed.

Accordingly, it is an object of the present invention to provide a method and apparatus for removing a heavier liquid from a container having a cover and containing a plurality of liquids of varying specific gravities utilizing a pressure acting between the container and an upper surface of a lighter liquid in the container to pressurize the heavier liquid and drive it through a conduit to an exterior location with respect to the container.

SUMMARY OF THE INVENTION

According to the present invention there is provided a method and apparatus for removing a relatively heavier liquid from a container having a plurality of liquids of differing specific gravities. The method includes the steps of (a) providing a sealable access to the container; (b) placing a conduit within the container such that an opening adjacent to a first end of the conduit is located within the relatively heavy liquid to be removed; (c) operably connecting a second portion of the conduit at a distance from the first end to the sealable access; (d) sealing the container such that a pressure can be generated between a portion of the container and a surface of a relatively light liquid located within the container; and (e) introducing a superatmospheric medium into the container from an exterior source to generate the pressure such that the relatively light liquid acts as a plunger to transfer the pressure to the relatively heavy liquid and force at least a portion of the heavy liquid through the conduit to a location exterior of the container via the sealable access.

The apparatus for removing a heavier liquid from a container having a cover and containing a plurality of liquids of differing specific gravities includes (a) a conduit at least partially located within the container and having an opening adjacent a first end of the conduit which is located within the relatively heavy liquid and an opposite second end which operably communicates with an exterior location with respect to the container; (b) a source of a superatmospheric medium which is exterior with respect to the container; and (c) a sealable access into the container which is operably connected to the source for introduction into the container of the superatmospheric medium, the sealable access further operably connected to the conduit such that the introduction of the superatmospheric medium generates a pressure between the container and an upper surface of a relatively light liquid within the container, the pressure sufficient to transfer a force through the relatively light liquid which acts as a plunger to pressurize the relatively heavy liquid such that the heavy liquid is driven into the opening in the conduit adjacent the first end and through the conduit to be directed to the exterior location via the sealable access.

BRIEF DESCRIPTION OF THE DRAWINGS

The features and advantages of the present invention will be more fully understood when the following description is read in light of the accompanying drawings in which.

DETAILED DESCRIPTION OF THE PREFERRED EMBODIMENTS

Figure 1:
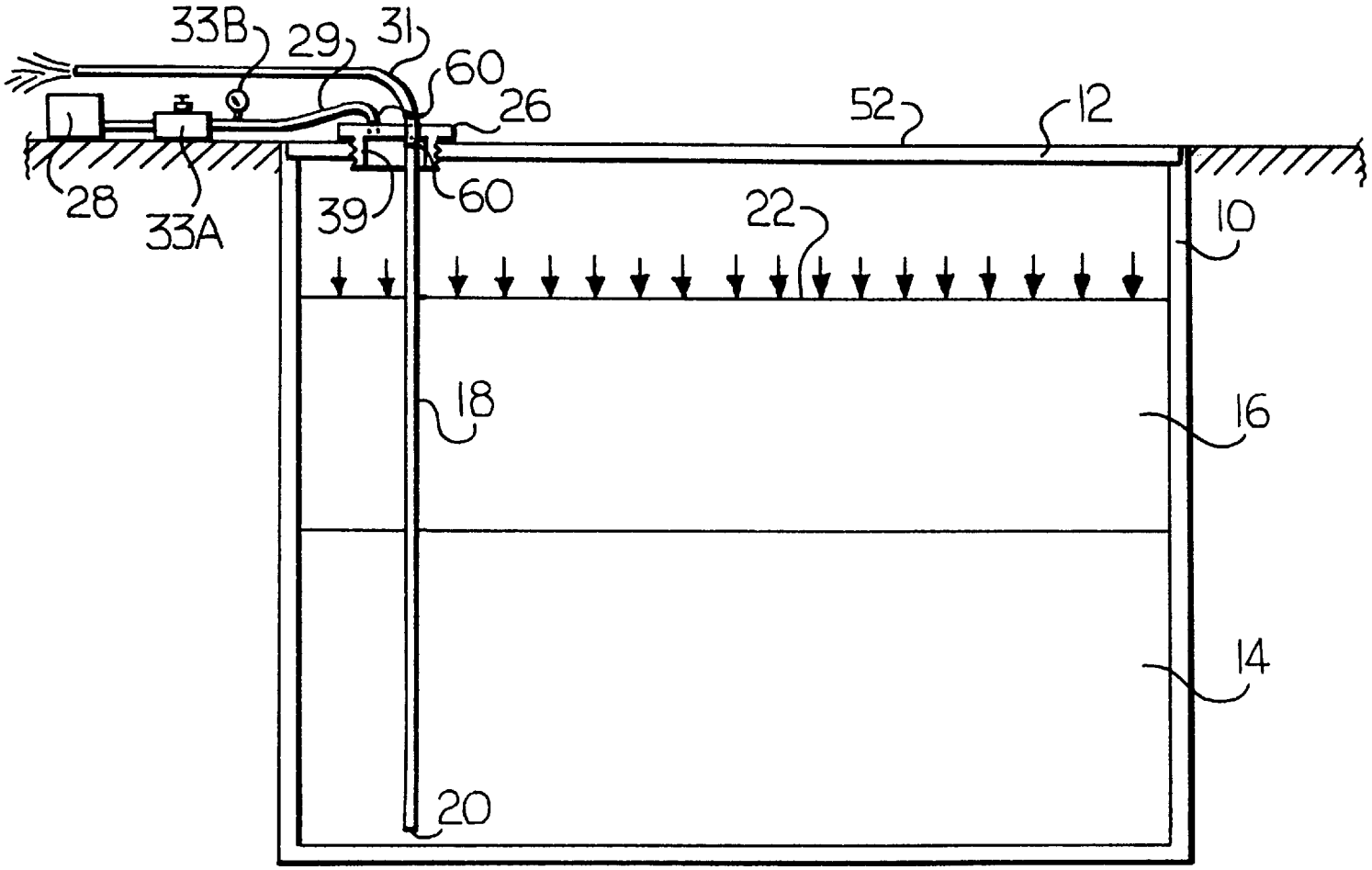
FIG. 1 is a side view partially in section illustrating an underground storage container for which the apparatus and method of the present invention is particularly useful.

Referring to FIG. 1, there is seen an underground liquid storage container 10 having a cover 12 for which the application of the present apparatus and method is particularly useful. Within the storage container there is seen to be distinct layers of liquid having varying specific gravities including a relatively heavy layer of water 14 and a relatively light layer of gasoline 16. The method includes the placement of a conduit, such as tube 18, into the container so that an opening adjacent to an end of the conduit is located within the layer of the heavy liquid to be removed from the container.

The method further includes the sealing of the container so that a pressure can be generated between the cover of the container and an upper surface 22 of the relatively light layer of gasoline 16. This requires a sealed connection both at the interface 24 between the cover 12 and the container 10 and at an access cap 26 to be discussed in further detail.

The method also includes the introduction of a superatmospheric medium, such as superatmospheric air, nitrogen or carbon dioxide, into the container 10 through the access cap 26 from a source 28. The source 28, can be a pressure vessel, such as a bottle or tank, in the case of air, nitrogen or carbon dioxide, or alternatively, the source can be a compressor which provides superatmospheric air as the medium. The medium generates a superatmospheric pressure between the cover 10 and the upper surface 22 of the gasoline layer 16. The downward force which is exerted on the upper surface 22 is transferred through the gasoline layer, which acts as a plunger, to uniformly pressurize the water layer 14. The magnitude of the pressure exerted on the water layer is selected to be sufficient to drive the water into the opening 20 in the tube 18, upward through the tube 18, and then out of the container through an opening in the access cap 26 to be ejected at an exterior location with respect to the container. A regulator valve 33A and a pressure gage 33B is used for measuring and controlling the pressure of the superatmospheric medium introduced into the container 10.

Figure 2:
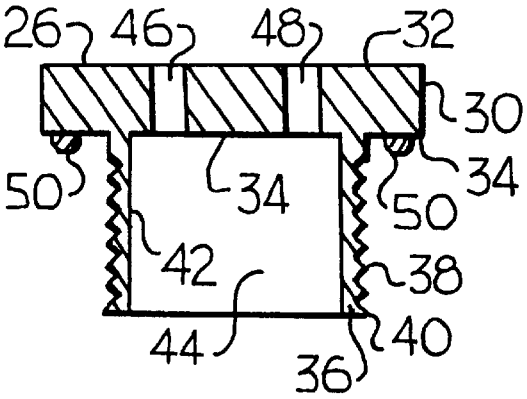
FIG. 2 is a side view in section of the access cap of the container of FIG. 1.
Figure 3:
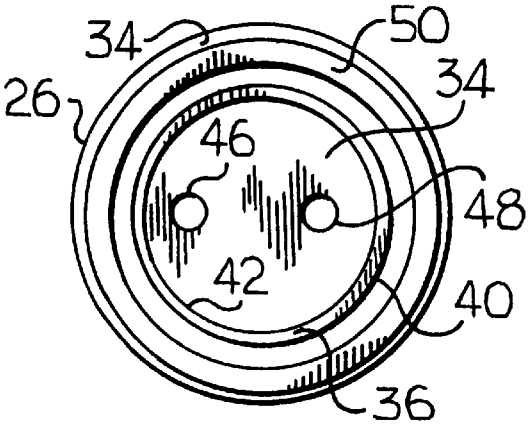
FIG. 3 is an end view of the access cap of FIG. 2.

Turning to FIGS. 2 and 3, the construction of the access cap 26 is shown in greater detail. The access cap includes a disc-shaped body portion 30 having an upper planar surface 32 and an oppositely located lower planar surface 34. Extending from the lower planar surface 34 of the body portion 30 is a cylindrical portion 36 having threads 38 on an outer surface 40. An inner surface 42 of the cylindrical portion 36 defines an access cavity 44 communicating with openings 46 and 48 which extend through the body portion 30 and which provide for the introduction of the medium into the container and the ejection of the water from the container, respectively.

Extending from the lower planar surface 34 of the body portion 30 at an outside diameter with respect to the threaded cylindrical portion 36 is a compressible annular ring 50. During threaded attachment of threads 38 of the access cap 26 to cooperative threads 39 formed in an opening in the cover 12, the annular ring 50 will contact an outer surface 52 of the cover 12 and will be compressed between the lower surface 34 and the outer surface 52 thereby providing a seal for the access cap 26.

Figure 4:
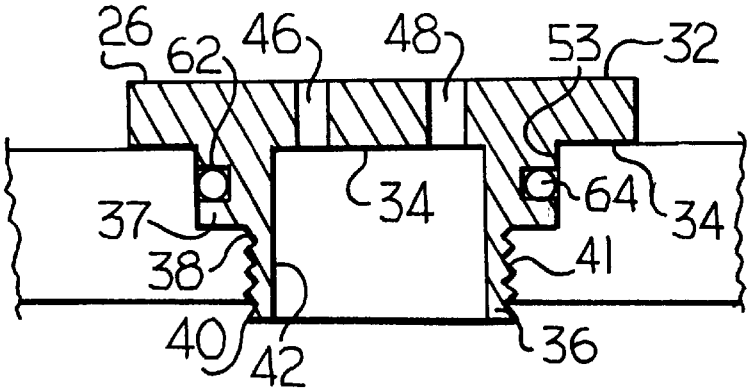
FIG. 4 is a side view in section of an access cap in which a seal groove is provided in a portion of the cylindrical portion of the cap for an o-ring.

The access cap 26 of FIG. 4 includes an annular seal groove 62 which has been formed in an unthreaded portion 37 of cylindrical portion 36. A separate compressible annular ring 64, per se known in the art as an o-ring, is positioned within the seal groove providing for sealing of the access cap by compression of the o-ring between the access cap 26 and a vertical surface 53 of the cover 12 during engagement of threads 38 in cooperative threads 41 in cover 12.

Figure 5:
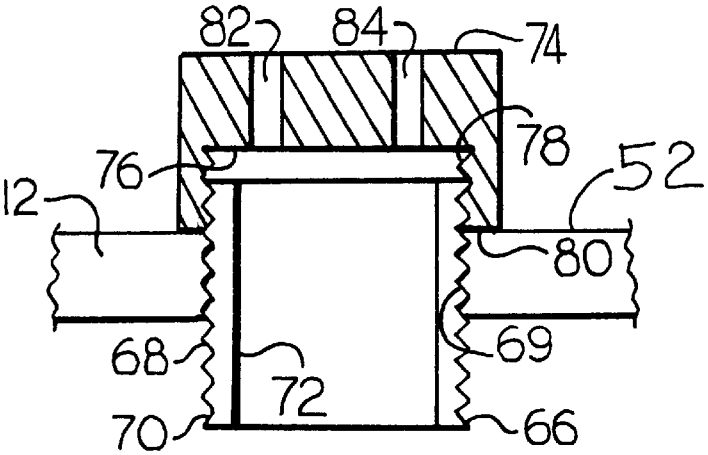
FIG. 5 is a side view in section of an alternative arrangement for providing a sealed access into the container utilizing an externally threaded tubular fitting and an internally threaded cap.

Referring to FIG. 5, an alternative arrangement for providing a sealed access to the container of FIG. 1 is illustrated. A tubular fitting 66 having threads 68 formed on an outer surface 70 and an opposite inner surface 72 is threadedly engaged in cooperative threads 69 in the cover 12 such that a portion of the fitting extends beyond the outer surface 52 of cover 12. An access cap 74 having a recess 76 with internal threads 78 is threadedly engaged to the portion of the fitting 66 which extends from the cover. The inner surface 72 of the fitting defines a passageway extending through the fitting. A seal between the access cap 74 and the cover is provided through contact between an annular end surface 80 of the access cap 74 and the outer surface 52 of the cover 12. Openings 82 and 84 in the access cap 74 provide for introduction of the medium into the container and the removal of the liquid from the container in the manner of openings 46 and 48, respectively, of the access caps of FIGS. 2 through 4.

Returning to FIG. 1, it is seen that a variety of connections need to be made in order to provide for the introduction of the medium into the container 10 through the cap 26 and for the ejection of the water via the tube 18, also through the access cap 26. Pneumatic tubing 29 from the medium source 28 will need to be connected to opening 46 in the access caps 26 of FIGS. 2–4 adjacent to the upper surface 32 of the body portion 30, or similarly in opening 82 in the access cap of FIG. 5. The end of the conduit opposite the conduit opening 20 will need to be connected to opening 48 in the access cap 26 adjacent to the lower surface 34 of the body portion 30. Finally, for the most preferred method, a second length of conduit 31 will be connected at an end to opening 48 adjacent to the upper surface 32 to convey the water from the container to the exterior location. Each of the above-mentioned connections can be made through the use of a quick-disconnect coupler 60, per se well known in the art.

Figure 6:
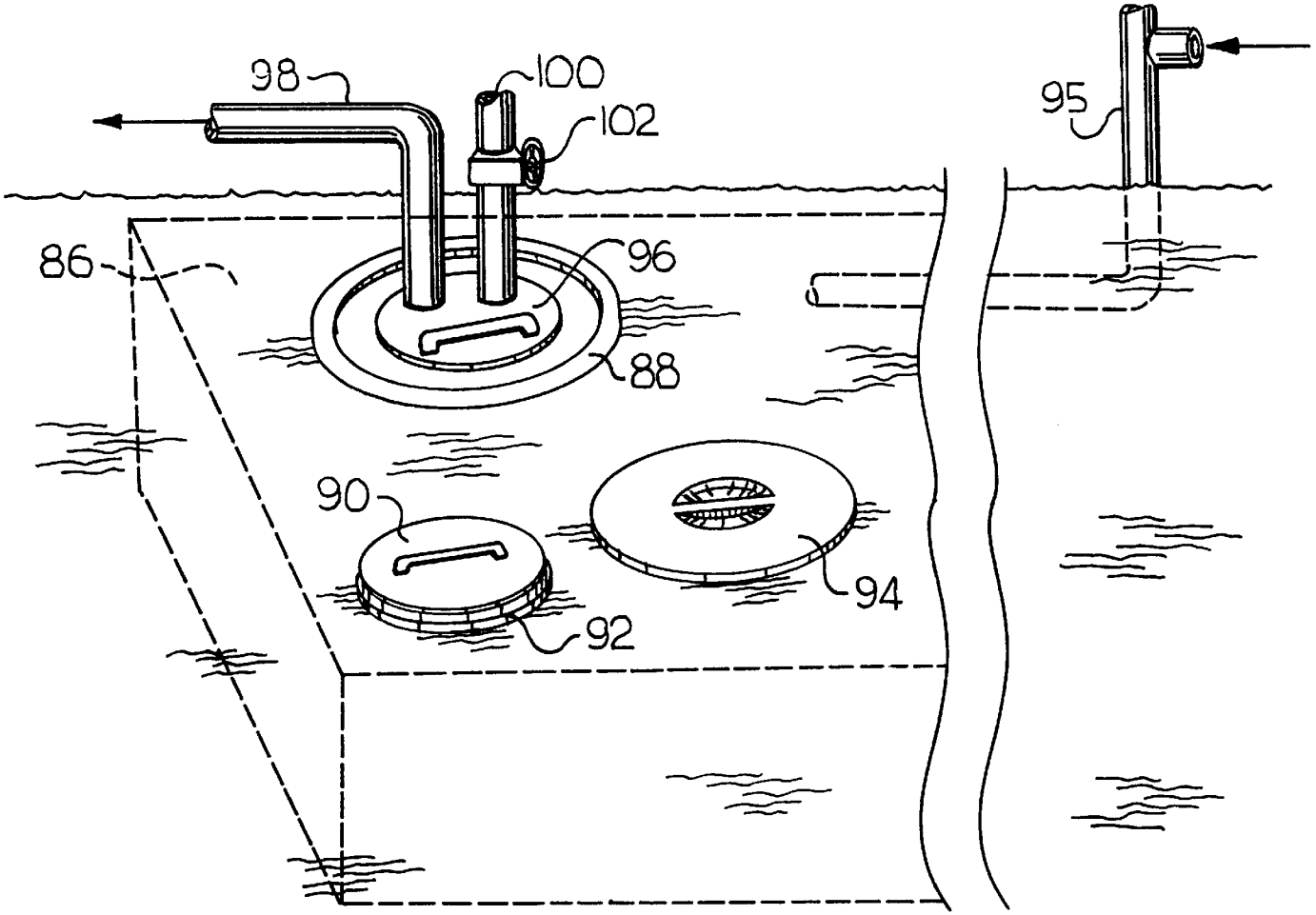
FIG. 6 is a side view partially in section of a gas station storage tank in which the vent is used for the pressure medium inlet and the fitting used by the gas company for filling of the tank is used as the fitting for the liquid removal conduit.

Referring to FIG. 6, there is illustrated an embodiment of the present invention for withdrawing contaminating water from an underground gasoline storage tank 86. The storage tank 86 includes an access 88 having a plug 90, shown removed from access 88. The plug 90 includes quick-disconnect coupling 92 along an edge for removal of the plug from access 88 and connection of a tanker truck line having compatible coupling during delivery of gasoline into the storage tank. The access also includes a cover 94, shown removed from the access, which provides for a generally flush surface when the access is not in use. The storage tank 86 also includes a vent 95 for maintaining atmospheric pressure within the storage tank.

In the present invention, a cap 96 having compatible quick-disconnect coupling around an outer periphery for connection to the tank is shown connected to access 88. In a similar fashion as the access cap 26 of FIG. 1, cap 96 includes a conduit, shown as tubing 98, extending from the access cap for removal of the contaminating water from storage tank 86.

The vent 95 is utilized for introduction of the superatmospheric medium into the tank through suitable connection of a pressure vessel or compressor, for example, to vent 95. The cap 96 also includes a second conduit, shown as tubing 100, having a valve 102 for release of superatmospheric pressure from within the storage tank upon completion of the removal of the contaminating water. This is an important safety feature particularly where check valving associated with vent 95 intended to provide for only entry of air into the tank upon removal of the stored gasoline prevents the release of superatmospheric pressure from within the tank. As an alternative to the use of vent 95 for introduction of the superatmospheric medium into storage tank 86, the second conduit 100 could be used for this purpose through suitable connection of a pressure vessel or compressor to conduit 100.

While the present invention has been described in connection with the preferred embodiments of the various figures, it is to be understood that other similar embodiments may be used or modifications and additions may be made to the described embodiments for performing the same function of the present invention without deviating therefrom. Therefore, the present invention should not be limited to any single embodiment, but rather construed in breadth and scope in accordance with the recitation of the appended claims.

I claim:

1. A method for removing a relatively heavy liquid from a container having a plurality of liquids of differing specific gravities, the method including the steps, not necessarily in the order presented, of:

(a) providing a sealable access to the container;

(b) placing a conduit within the container such that an opening adjacent to a first end of said conduit is located within the relatively heavy liquid to be removed;

(c) operably connecting a second portion of said conduit at a distance from said first end to said sealable access;

(d) sealing the container such that a pressure can be generated between a portion of the container and a surface of a relatively light liquid located within the container; and (e) introducing a superatmospheric medium into the container from an exterior source to generate said pressure such that said relatively light liquid acts as a plunger to transfer said pressure to said relatively heavy liquid and force at least a portion of said heavy liquid through said conduit to a location exterior of the container via said sealable access.

2. The method according to claim 1, wherein said relatively heavy liquid is water and said relatively light liquid is gasoline.

3. The method according to claim 1, wherein said exterior source is a compressor and wherein said superatmospheric medium is air.

4. The method according to claim 1, wherein said exterior source is a pressure vessel and wherein said superatmospheric medium is nitrogen.

5. The method according to claim 1, wherein said exterior source is a pressure vessel and wherein said superatmospheric medium is carbon dioxide.

6. The method according to claim 1, wherein the container includes a cover and wherein the step of providing a sealable access includes the steps of providing an opening in said cover and wherein the step of sealing the container includes the step of operably attaching a sealable cap to said opening in said cover, said cap having a first opening extending through said cap to provide a pathway through the cap for removal of said heavy liquid during said step of introducing a superatmospheric medium.

7. The method according to claim 6, wherein the step of providing an opening in said cap includes the step of providing threads in said cover and wherein said cap includes a threaded portion and wherein said step of operably attaching said cap includes the step of threadedly engaging said cap to said threads in said cover.

8. The method according to claim 6, wherein said cap further includes a second opening extending through said cap and wherein said step of sealing the container includes the step of operably connecting a first end of a pneumatic tube to said second opening and operably connecting a second end of said pneumatic tube opposite said first end to said exterior source.

9. The method according to claim 7, wherein said cap includes a sealing surface located adjacent to an outer periphery of said cap at an outside diameter with respect to said threaded portion and a compressible annular ring extending from said sealing surface and wherein said step of sealing the container includes the step of compressing said ring between said sealing surface of said cap and an outer surface of said cover.

10. The method according to claim 7, wherein said cap includes a seal groove in an unthreaded portion adjacent said threaded portion and a compressible o-ring located within said seal groove and wherein said step of sealing the container includes the step of compressing said o-ring between said seal groove of said cap and a surface of said cover.

11. The method according to claim 6, wherein the step of providing an opening in said cap includes the step of providing threads in said cover and wherein said step of operably attaching said sealable cap includes the steps of threadedly engaging an externally threaded fitting having an internal passageway extending through said fitting to the threads of said cover such that a portion of said fitting extends beyond an outer surface of said cover and threadedly engaging said cap to said fitting until a surface of said cap contacts said outer surface of said cover.

12. The method according to claim 1, wherein said container is an underground gasoline storage tank having an access to which a tanker truck line is connectable by quick-disconnect coupling during supply of gasoline to said storage tank and a vent for maintaining atmospheric pressure within said storage tank and wherein said step of placing a conduit within the container includes connection of a cap operably connected to said conduit to said access by quick-disconnect coupling.

13. The method according to claim 12, wherein said cap is further operably connected to a second conduit and wherein said step of introducing a superatmospheric medium into the container utilizes said second conduit.

14. The method according to claim 12, wherein said step of introducing a superatmospheric medium into said container includes delivery of said superatmospheric medium into said container via said vent.

15. The method according to claim 12, wherein said cap is further operably connected to a second conduit having a valve and wherein the method includes the further step of opening said valve to release superatmospheric pressure from said container.

* * * * *